US007887238B2

(12) United States Patent
Turvey et al.

(10) Patent No.: US 7,887,238 B2
(45) Date of Patent: Feb. 15, 2011

(54) FLOW CHANNELS FOR A POUCH

(75) Inventors: Robert R. Turvey, Sanford, MI (US); Brian C. Dais, Saginaw, MI (US); Daniel P. Zimmerman, Livonia, MI (US); Kelly M. Griffioen, Kalamazoo, MI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 914 days.

(21) Appl. No.: 11/818,584

(22) Filed: Jun. 15, 2007

(65) Prior Publication Data

US 2008/0310776 A1 Dec. 18, 2008

(51) Int. Cl.
*B65D 33/00* (2006.01)
*B65D 33/01* (2006.01)
*B65D 33/16* (2006.01)

(52) U.S. Cl. ..... 383/105; 383/103; 383/63

(58) Field of Classification Search ..... 383/105, 383/103, 63; 222/107
See application file for complete search history.

(56) References Cited

U.S. PATENT DOCUMENTS

| | | | |
|---|---|---|---|
| 2,576,322 | A | 11/1951 | Waters |
| 2,609,314 | A | 9/1952 | Engel et al. |
| 2,633,442 | A | 3/1953 | Caldwell |
| 2,642,372 | A | 6/1953 | Chittick |
| 2,670,501 | A | 3/1954 | Michiels |
| 2,759,866 | A | 8/1956 | Seymour |
| 2,772,712 | A | 12/1956 | Post |
| 2,776,452 | A | 1/1957 | Chavannes |
| 2,778,171 | A | 1/1957 | Taunton |
| 2,778,173 | A | 1/1957 | Taunton |
| 2,821,338 | A | 1/1958 | Metzger |
| 2,856,323 | A | 10/1958 | Gordon |
| 2,858,247 | A | 10/1958 | De Swart |
| 2,870,954 | A | 1/1959 | Kulesza |
| 2,913,030 | A | 11/1959 | Fisher |
| 2,916,411 | A | 12/1959 | Villoresi |
| 2,927,722 | A | 3/1960 | Metzger |
| 2,960,144 | A | 11/1960 | Graf |
| 3,026,231 | A | 3/1962 | Chavannes |
| 3,060,985 | A | 10/1962 | Vance et al. |
| 3,077,428 | A | 2/1963 | Heuser et al. |
| 3,098,563 | A | 7/1963 | Skees |
| 3,102,676 | A | 9/1963 | Danelli et al. |
| 3,113,715 | A | 12/1963 | Pangrac |
| 3,141,221 | A | 7/1964 | Faulls, Jr. |

(Continued)

FOREIGN PATENT DOCUMENTS

| | | |
|---|---|---|
| CA | 1315746 | 4/1993 |

(Continued)

*Primary Examiner*—Jes F Pascua

(57) ABSTRACT

A pouch includes first and second opposing pouch walls and a plurality of flow channel protuberances that defines a flow channel between the first and second pouch walls and is disposed on an inner surface of at least one of the first or second pouch walls. At least one of the plurality of protuberances includes a first component extending from the at least one of the first or second pouch walls and a second component extending at a non-zero angle from the first component. The flow channel extends between an opening of the pouch and a portion of an interior of the pouch that is spaced from the opening.

12 Claims, 5 Drawing Sheets

U.S. PATENT DOCUMENTS

| | | | | |
|---|---|---|---|---|
| 3,142,599 | A | | 7/1964 | Chavannes |
| 3,149,772 | A | | 9/1964 | Olsson |
| 3,160,323 | A | | 12/1964 | Weisberg |
| 3,216,172 | A | | 11/1965 | Piazze |
| 3,219,084 | A | | 11/1965 | Ausnit et al. |
| 3,224,574 | A | | 12/1965 | McConnell |
| 3,237,844 | A | | 3/1966 | Hughes |
| 3,251,463 | A | | 5/1966 | Bodet |
| 3,260,412 | A | * | 7/1966 | Larkin ..... 222/107 |
| 3,302,859 | A | | 2/1967 | Perry |
| 3,325,084 | A | | 6/1967 | Ausnit |
| 3,372,442 | A | | 3/1968 | Ishimatsu |
| 3,381,887 | A | | 5/1968 | Lowry |
| 3,389,733 | A | | 6/1968 | Siegel |
| 3,411,698 | A | | 11/1968 | Reynolds |
| 3,423,231 | A | | 1/1969 | Lutzmann |
| 3,440,696 | A | | 4/1969 | Staller |
| 3,464,094 | A | | 9/1969 | Mates |
| 3,508,587 | A | * | 4/1970 | Mauch ..... 138/119 |
| 3,516,217 | A | | 6/1970 | Gildersleeve |
| 3,557,413 | A | | 1/1971 | Engle |
| 3,565,147 | A | | 2/1971 | Ausnit |
| 3,575,781 | A | | 4/1971 | Pezely |
| 3,595,467 | A | | 7/1971 | Goglio |
| 3,595,722 | A | | 7/1971 | Dawbarn |
| 3,595,740 | A | | 7/1971 | Gerow |
| 3,600,267 | A | | 8/1971 | McFedries, Jr. et al. |
| 3,608,439 | A | | 9/1971 | Ausnit |
| 3,628,720 | A | | 12/1971 | Schmedding |
| 3,633,642 | A | | 1/1972 | Siegel |
| 3,655,501 | A | | 4/1972 | Tesch |
| 3,661,677 | A | | 5/1972 | Wang |
| 3,679,511 | A | | 7/1972 | Ausnit |
| 3,746,215 | A | | 7/1973 | Ausnit et al. |
| 3,762,404 | A | | 10/1973 | Sakita |
| 3,780,781 | A | | 12/1973 | Uramoto |
| 3,790,992 | A | | 2/1974 | Herz |
| 3,799,427 | A | | 3/1974 | Goglio |
| 3,809,217 | A | | 5/1974 | Harrison |
| 3,833,166 | A | | 9/1974 | Murray |
| 3,908,070 | A | | 9/1975 | Marzolf |
| 3,918,131 | A | | 11/1975 | Ausnit |
| 3,937,396 | A | | 2/1976 | Schneider |
| 3,980,226 | A | | 9/1976 | Franz |
| 3,989,182 | A | | 11/1976 | Stearley |
| 4,000,846 | A | | 1/1977 | Gilbert |
| 4,020,884 | A | | 5/1977 | Jadot |
| 4,085,886 | A | | 4/1978 | Nishioka |
| 4,101,355 | A | | 7/1978 | Ausnit |
| 4,104,404 | A | | 8/1978 | Bieler et al. |
| 4,105,491 | A | | 8/1978 | Haase et al. |
| 4,122,993 | A | | 10/1978 | Glas |
| 4,134,535 | A | | 1/1979 | Barthels et al. |
| 4,155,453 | A | | 5/1979 | Ono |
| 4,186,786 | A | | 2/1980 | Kirkpatrick |
| 4,206,870 | A | | 6/1980 | DeVries |
| 4,212,337 | A | | 7/1980 | Kamp |
| 4,215,725 | A | | 8/1980 | Callet et al. |
| 4,246,288 | A | | 1/1981 | Sanborn, Jr. |
| 4,267,960 | A | | 5/1981 | Lind et al. |
| 4,310,118 | A | | 1/1982 | Kisida et al. |
| 4,332,344 | A | | 6/1982 | Strodthoff |
| 4,340,558 | A | | 7/1982 | Hendrickson |
| 4,354,541 | A | | 10/1982 | Tilman |
| 4,355,494 | A | | 10/1982 | Tilman |
| 4,363,345 | A | | 12/1982 | Scheibner |
| 4,364,989 | A | | 12/1982 | Moyle |
| 4,370,187 | A | | 1/1983 | Katagiri et al. |
| 4,372,921 | A | | 2/1983 | Sanderson et al. |
| 4,426,816 | A | | 1/1984 | Dean et al. |
| 4,430,070 | A | | 2/1984 | Ausnit |
| 4,449,243 | A | | 5/1984 | Platel |
| 4,470,153 | A | | 9/1984 | Kenan |
| 4,491,959 | A | | 1/1985 | Loefberg |
| 4,509,642 | A | | 4/1985 | Rowell |
| 4,524,460 | A | | 6/1985 | Twiehoff et al. |
| 4,528,224 | A | | 7/1985 | Ausnit |
| 4,532,652 | A | | 7/1985 | Herrington |
| 4,541,117 | A | | 9/1985 | Ashbeck |
| 4,550,546 | A | | 11/1985 | Raley et al. |
| 4,551,379 | A | | 11/1985 | Kerr |
| 4,566,131 | A | | 1/1986 | Achelpohl |
| 4,569,712 | A | | 2/1986 | Shibano et al. |
| 4,576,283 | A | | 3/1986 | Fafournoux |
| 4,576,285 | A | | 3/1986 | Goglio |
| 4,578,813 | A | | 3/1986 | Ausnit |
| 4,579,784 | A | | 4/1986 | Lemstra et al. |
| 4,581,764 | A | | 4/1986 | Plock et al. |
| 4,612,221 | A | | 9/1986 | Biel et al. |
| 4,653,661 | A | | 3/1987 | Buchner et al. |
| 4,658,434 | A | | 4/1987 | Murray |
| 4,660,355 | A | | 4/1987 | Kristen |
| 4,672,684 | A | | 6/1987 | Barnes et al. |
| 4,683,702 | A | | 8/1987 | Vis |
| 4,691,372 | A | | 9/1987 | Van Erden |
| 4,691,373 | A | | 9/1987 | Ausnit |
| 4,701,358 | A | | 10/1987 | Behr et al. |
| 4,702,376 | A | | 10/1987 | Pagliaro |
| 4,705,174 | A | | 11/1987 | Goglio |
| 4,712,574 | A | | 12/1987 | Perrott |
| 4,715,494 | A | | 12/1987 | Heitzenröder et al. |
| 4,730,635 | A | | 3/1988 | Linden |
| 4,731,911 | A | | 3/1988 | Gould |
| 4,736,450 | A | | 4/1988 | Van Erden et al. |
| 4,736,451 | A | | 4/1988 | Ausnit |
| 4,747,702 | A | | 5/1988 | Scheibner |
| 4,752,992 | A | | 6/1988 | Kondo et al. |
| 4,756,628 | A | | 7/1988 | Branson |
| 4,756,629 | A | | 7/1988 | Tilman et al. |
| 4,778,282 | A | | 10/1988 | Borchardt et al. |
| 4,780,937 | A | | 11/1988 | Kusayama |
| 4,782,951 | A | | 11/1988 | Griesbach et al. |
| 4,784,885 | A | | 11/1988 | Carespodi |
| 4,787,754 | A | | 11/1988 | Herrington |
| 4,787,755 | A | | 11/1988 | Branson |
| 4,787,880 | A | | 11/1988 | Ausnit |
| 4,791,710 | A | | 12/1988 | Nocek et al. |
| 4,792,240 | A | | 12/1988 | Ausnit |
| 4,795,269 | A | | 1/1989 | Scheibner |
| 4,796,300 | A | | 1/1989 | Branson |
| 4,807,300 | A | | 2/1989 | Ausnit et al. |
| 4,812,056 | A | | 3/1989 | Zieke |
| 4,812,074 | A | | 3/1989 | Ausnit et al. |
| 4,817,188 | A | | 3/1989 | Van Erden |
| 4,825,514 | A | | 5/1989 | Akeno |
| 4,829,641 | A | | 5/1989 | Williams |
| 4,832,505 | A | | 5/1989 | Ausnit et al. |
| 4,834,554 | A | | 5/1989 | Stetler, Jr. et al. |
| 4,840,611 | A | | 6/1989 | Van Erden et al. |
| 4,841,603 | A | | 6/1989 | Ragni |
| 4,858,286 | A | | 8/1989 | Siegel |
| 4,859,259 | A | | 8/1989 | Scheibner |
| 4,863,286 | A | | 9/1989 | Branson |
| 4,869,725 | A | | 9/1989 | Schneider et al. |
| 4,875,259 | A | | 10/1989 | Appeldorn |
| 4,877,334 | A | | 10/1989 | Cope |
| 4,878,763 | A | | 11/1989 | Ausnit |
| 4,890,637 | A | | 1/1990 | Lamparter |
| 4,890,935 | A | | 1/1990 | Ausnit et al. |
| 4,892,414 | A | | 1/1990 | Ausnit |
| 4,903,718 | A | | 2/1990 | Sullivan |
| 4,907,321 | A | | 3/1990 | Williams |
| 4,909,017 | A | | 3/1990 | McMahon et al. |
| 4,911,960 | A | | 3/1990 | Mudge et al. |

4,923,701 A 5/1990 VanErden
4,925,318 A 5/1990 Sorenson
4,928,829 A 5/1990 Di Bernardo
4,929,487 A 5/1990 Tilman et al.
4,930,904 A 6/1990 Gröner et al.
4,937,139 A 6/1990 Genske et al.
4,947,525 A 8/1990 Van Erden
4,953,708 A 9/1990 Beer et al.
4,961,944 A 10/1990 Matoba et al.
4,964,739 A 10/1990 Branson et al.
4,965,108 A 10/1990 Biel et al.
4,966,470 A 10/1990 Thompson et al.
4,971,845 A 11/1990 Aaker et al.
4,985,192 A 1/1991 Roeder et al.
5,007,143 A 4/1991 Herrington
5,009,318 A 4/1991 Lepinoy
5,012,561 A 5/1991 Porchia et al.
5,017,021 A 5/1991 Simonsen et al.
5,022,530 A 6/1991 Zieke
RE33,674 E 8/1991 Uramoto
5,037,138 A 8/1991 McClintock et al.
5,041,316 A 8/1991 Parnell et al.
5,044,774 A 9/1991 Bullard et al.
5,053,091 A 10/1991 Giljam et al.
5,056,933 A 10/1991 Kamp
5,059,036 A 10/1991 Richison et al.
5,067,208 A 11/1991 Herrington, Jr. et al.
5,067,822 A 11/1991 Wirth et al.
5,069,962 A 12/1991 Okazaki et al.
5,070,584 A 12/1991 Dais et al.
5,088,162 A 2/1992 Allan
5,088,971 A 2/1992 Herrington
5,092,684 A 3/1992 Weeks
5,093,164 A 3/1992 Bauer et al.
5,093,188 A 3/1992 Dohrer
5,119,531 A 6/1992 Berger et al.
5,120,586 A 6/1992 Nedzu et al.
5,134,001 A 7/1992 Osgood
5,140,727 A 8/1992 Dais et al.
5,140,796 A 8/1992 Pope
5,141,577 A 8/1992 Porchia et al.
5,142,970 A 9/1992 ErkenBrack
5,167,454 A 12/1992 Woods et al.
5,168,586 A 12/1992 Small
5,170,990 A 12/1992 Kamiya et al.
5,174,658 A 12/1992 Cook et al.
5,177,332 A 1/1993 Fong
5,179,767 A 1/1993 Allan
5,186,543 A 2/1993 Cochran
5,188,461 A 2/1993 Sorenson
5,189,764 A 3/1993 Herrington et al.
5,192,135 A 3/1993 Woods et al.
5,198,055 A 3/1993 Wirth et al.
5,203,458 A 4/1993 Cornwell
5,208,096 A 5/1993 Dohrer
5,209,264 A 5/1993 Koyanagi
5,209,574 A 5/1993 Tilman
5,209,972 A 5/1993 Super et al.
5,211,481 A 5/1993 Tilman
5,212,855 A 5/1993 McGanty
5,216,787 A 6/1993 Custer et al.
5,228,271 A 7/1993 Wallace
5,235,731 A 8/1993 Anzai et al.
5,236,749 A 8/1993 Ewing
5,238,306 A 8/1993 Heintz et al.
5,240,112 A 8/1993 Newburger
5,242,516 A 9/1993 Custer et al.
5,242,757 A 9/1993 Buisine et al.
5,246,114 A 9/1993 Underwood
5,248,201 A 9/1993 Kettner et al.
5,252,281 A 10/1993 Kettner et al.
5,252,379 A 10/1993 Kuribayashi et al.
5,254,073 A 10/1993 Richison et al.
5,263,777 A 11/1993 Domke
RE34,477 E 12/1993 Cornwell
5,272,794 A 12/1993 Hamatani et al.
5,283,932 A 2/1994 Richardson et al.
RE34,554 E 3/1994 Ausnit
5,293,672 A 3/1994 Tominaga et al.
5,300,354 A 4/1994 Harita et al.
5,301,394 A 4/1994 Richardson et al.
5,301,395 A 4/1994 Richardson et al.
5,308,666 A 5/1994 Borchardt
5,320,889 A 6/1994 Bettle, III
5,324,572 A 6/1994 Kuechler et al.
5,326,176 A 7/1994 Domke
5,332,095 A 7/1994 Wu
5,333,736 A 8/1994 Kawamura
5,339,602 A 8/1994 Landers et al.
5,339,959 A 8/1994 Cornwell
5,342,684 A 8/1994 Carespodi
5,346,312 A 9/1994 Mabry et al.
5,351,369 A 10/1994 Swain
5,351,828 A 10/1994 Becker et al.
5,354,133 A 10/1994 Rapparini
5,356,222 A 10/1994 Kettner et al.
5,360,670 A 11/1994 Yonezu et al.
5,362,351 A 11/1994 Karszes
5,366,294 A 11/1994 Wirth et al.
5,368,394 A 11/1994 Scott et al.
5,369,847 A 12/1994 Naya et al.
5,371,925 A 12/1994 Sawatsky
5,376,392 A 12/1994 Ikegami et al.
5,382,470 A 1/1995 Vicik
5,384,942 A 1/1995 Siegel
5,388,910 A 2/1995 Koyanagi
5,397,182 A 3/1995 Gaible et al.
5,399,022 A 3/1995 Sheets
5,403,094 A 4/1995 Tomic
5,407,087 A 4/1995 Giblin et al.
RE34,929 E 5/1995 Kristen
5,415,904 A 5/1995 Takubo et al.
5,417,035 A 5/1995 English
5,417,495 A 5/1995 Branson
5,419,638 A 5/1995 Jamison
5,435,864 A 7/1995 Machacek et al.
5,443,851 A 8/1995 Christie et al.
5,445,870 A 8/1995 Buchner et al.
5,448,807 A 9/1995 Herrington, Jr.
5,450,963 A 9/1995 Carson
5,456,979 A 10/1995 Schirmer
5,462,473 A 10/1995 Sheller
5,469,966 A 11/1995 Boyer
5,474,818 A 12/1995 Ulrich et al.
5,480,030 A 1/1996 Sweeney et al.
5,492,241 A 2/1996 Barnett et al.
5,494,165 A 2/1996 Detrick
5,497,911 A * 3/1996 Ellion et al. ..... 222/95
5,509,734 A 4/1996 Ausnit
5,511,884 A 4/1996 Bruno et al.
5,520,463 A 5/1996 Tilman
5,523,236 A 6/1996 Nuzzo
5,525,363 A 6/1996 Herber et al.
5,526,843 A 6/1996 Wolf et al.
5,540,500 A 7/1996 Tanaka
5,540,557 A 7/1996 Carson
5,542,902 A 8/1996 Richison et al.
5,544,752 A 8/1996 Cox
5,545,419 A 8/1996 Brady et al.
5,549,944 A 8/1996 Abate
5,551,127 A 9/1996 May
5,553,942 A 9/1996 Domke et al.
5,554,423 A 9/1996 Abate
5,558,439 A 9/1996 Tilman
5,558,613 A 9/1996 Tilman et al.
5,566,429 A 10/1996 Martinez et al.

5,567,533 A 10/1996 Toney et al.
5,573,614 A 11/1996 Tilman et al.
5,577,305 A 11/1996 Johnson
5,584,409 A 12/1996 Chemberlen
5,587,192 A 12/1996 Beizermann
5,588,187 A 12/1996 Swain
5,592,697 A 1/1997 Young
5,603,995 A 2/1997 Takubo et al.
5,609,420 A 3/1997 Palmisano
5,618,111 A 4/1997 Porchia et al.
5,622,431 A 4/1997 Simonsen
5,628,566 A 5/1997 Schreiter
5,638,971 A 6/1997 Justesen
RE35,567 E 7/1997 Newsome
5,653,251 A 8/1997 Handler
5,655,273 A 8/1997 Tomic et al.
5,655,842 A 8/1997 Hagino
5,660,479 A 8/1997 May et al.
5,664,303 A 9/1997 Johnson
5,669,715 A 9/1997 Dobreski et al.
5,672,009 A 9/1997 Malin
5,689,866 A 11/1997 Kasai et al.
5,693,283 A 12/1997 Fehn
5,699,838 A 12/1997 Catallo et al.
5,700,091 A 12/1997 Tanaka et al.
5,701,996 A 12/1997 Goto et al.
5,709,479 A 1/1998 Bell
5,709,915 A 1/1998 Tomic et al.
5,713,669 A 2/1998 Thomas et al.
5,718,024 A 2/1998 Robbins
5,729,876 A 3/1998 Johnson
5,730,919 A 3/1998 Wilfong et al.
5,733,619 A 3/1998 Patel et al.
5,735,317 A 4/1998 Wu
5,735,395 A 4/1998 Lo
5,749,493 A 5/1998 Boone et al.
5,749,658 A 5/1998 Kettner
5,753,895 A 5/1998 Olson et al.
5,769,772 A 6/1998 Wiley
5,770,287 A 6/1998 Miranda et al.
5,774,954 A 7/1998 Ramsey et al.
5,775,812 A 7/1998 St. Phillips et al.
5,782,562 A 7/1998 Anspacher
5,782,733 A 7/1998 Yeager
5,784,862 A 7/1998 Germano
5,786,010 A 7/1998 Yannuzzi, Jr.
5,791,783 A 8/1998 Porchia et al.
5,794,315 A 8/1998 Crabtree et al.
5,804,265 A 9/1998 Saad et al.
5,827,163 A 10/1998 Kettner
5,829,884 A 11/1998 Yeager
5,830,545 A 11/1998 Frisk
5,833,791 A 11/1998 Bryniarski et al.
5,839,582 A 11/1998 Strong et al.
5,839,831 A 11/1998 Mazzocchi
5,839,832 A 11/1998 Hagino
5,843,578 A 12/1998 Sasaki et al.
5,855,498 A 1/1999 Spector
5,871,281 A 2/1999 Stolmeier et al.
5,871,790 A 2/1999 Monier et al.
5,874,155 A 2/1999 Gehrke et al.
5,875,611 A 3/1999 Plourde
5,881,881 A 3/1999 Carrington
5,882,120 A 3/1999 Bell
5,893,461 A 4/1999 Walters
5,893,645 A 4/1999 May
5,894,929 A 4/1999 Kai et al.
5,898,113 A 4/1999 Vecere
5,902,046 A 5/1999 Shibata
5,902,047 A 5/1999 Yeager
5,911,508 A 6/1999 Dobreski et al.
5,915,596 A 6/1999 Credle, Jr.
5,919,535 A 7/1999 Dobreski et al.
5,919,547 A 7/1999 Kocher et al.
5,924,173 A 7/1999 Dobreski et al.
5,924,795 A 7/1999 Thompson et al.
5,927,336 A 7/1999 Tanaka et al.
5,927,855 A 7/1999 Tomic et al.
5,928,762 A 7/1999 Aizawa et al.
5,930,877 A 8/1999 Thorpe et al.
5,931,189 A 8/1999 Sweeney et al.
5,931,582 A 8/1999 Nichols
5,933,927 A 8/1999 Miller et al.
5,941,421 A 8/1999 Overman et al.
5,941,643 A 8/1999 Linkiewicz
5,944,425 A 8/1999 Forman
5,947,603 A 9/1999 Tilman
5,951,453 A 9/1999 Yeager
5,953,796 A 9/1999 McMahon et al.
5,954,196 A 9/1999 Lin
5,954,433 A 9/1999 Yeager
5,956,815 A 9/1999 O'Connor et al.
5,964,532 A 10/1999 St. Phillips et al.
5,965,224 A 10/1999 Chen et al.
5,967,664 A 10/1999 Giles et al.
5,971,613 A 10/1999 Bell
5,981,028 A 11/1999 Sugawa et al.
5,983,466 A 11/1999 Petkovsek
5,985,391 A 11/1999 Denehy et al.
5,988,426 A 11/1999 Stern
5,988,880 A 11/1999 Tomic
5,989,608 A 11/1999 Mizuno
5,992,442 A 11/1999 Urquhart et al.
5,992,635 A 11/1999 Walters
5,996,800 A 12/1999 Pratt
6,004,032 A 12/1999 Kapperman et al.
6,009,603 A 1/2000 Gallagher
6,010,244 A 1/2000 Dobreski et al.
6,012,264 A 1/2000 Linkiewicz
6,014,795 A 1/2000 McMahon et al.
6,017,412 A 1/2000 Van Erden et al.
6,019,512 A 2/2000 Yeager
6,021,624 A 2/2000 Richison et al.
6,023,914 A 2/2000 Richison et al.
6,029,810 A 2/2000 Chen
6,030,122 A 2/2000 Ramsey et al.
6,033,113 A 3/2000 Anderson
6,033,114 A 3/2000 Grimm et al.
6,039,182 A 3/2000 Light
6,044,621 A 4/2000 Malin et al.
6,045,264 A 4/2000 Miniea
6,045,546 A 4/2000 Drago et al.
6,045,648 A 4/2000 Palmgren et al.
6,047,450 A 4/2000 Machacek et al.
6,056,439 A 5/2000 Graham
6,059,456 A 5/2000 May
6,059,457 A 5/2000 Spreche et al.
6,068,898 A 5/2000 Oyama
6,070,397 A 6/2000 Bachhuber
6,070,728 A 6/2000 Overby et al.
6,071,011 A 6/2000 Thomas et al.
6,071,626 A 6/2000 Frisk
6,074,096 A 6/2000 Tilman
6,076,967 A 6/2000 Beaudette
6,077,578 A 6/2000 Valyi
6,080,252 A 6/2000 Plourde
6,082,897 A 7/2000 Galomb
6,083,584 A 7/2000 Smith et al.
6,085,906 A 7/2000 Lambert
6,085,922 A 7/2000 Esser
6,092,931 A 7/2000 Tilman
6,103,050 A 8/2000 Krueger
6,110,586 A 8/2000 Johnson
6,112,374 A 9/2000 Van Erden
6,116,781 A 9/2000 Skeens
6,117,505 A 9/2000 Weiss et al.

6,120,817 A 9/2000 Archibald et al.
6,126,013 A 10/2000 Miller
6,126,975 A 10/2000 Archibald et al.
6,132,089 A 10/2000 Galomb et al.
6,138,329 A 10/2000 Johnson
6,146,764 A 11/2000 Suokas et al.
6,148,588 A 11/2000 Thomas et al.
6,149,302 A 11/2000 Taheri
6,149,304 A 11/2000 Hamilton et al.
6,152,601 A 11/2000 Johnson
6,156,363 A 12/2000 Chen et al.
6,164,825 A 12/2000 Larkin et al.
6,167,597 B1 1/2001 Malin
6,170,985 B1 1/2001 Shabram, Jr. et al.
6,176,613 B1 1/2001 Chen
6,177,172 B1 1/2001 Yeager
6,178,602 B1 1/2001 Burke et al.
6,182,337 B1 2/2001 Machacek et al.
6,182,850 B1 2/2001 Marbler et al.
6,185,796 B1 2/2001 Ausnit
6,194,011 B1 2/2001 Glaser
6,194,043 B1 2/2001 Fehn
6,202,849 B1 3/2001 Graham
6,203,867 B1 3/2001 Derkach et al.
6,203,915 B1 3/2001 Prissok et al.
6,209,287 B1 4/2001 Thieman
6,217,216 B1 4/2001 Taheri
6,218,024 B1 4/2001 Tamber et al.
6,220,754 B1 4/2001 Stiglic et al.
6,224,262 B1 5/2001 Hogan et al.
6,227,706 B1 5/2001 Tran
6,231,236 B1 5/2001 Tilman
6,231,975 B1 5/2001 Kong et al.
6,240,941 B1 6/2001 Small et al.
6,244,021 B1 6/2001 Ausnit et al.
6,244,748 B1 6/2001 Kasai et al.
6,248,442 B1 6/2001 Kong et al.
6,257,763 B1 7/2001 Stolmeier et al.
6,270,257 B1 8/2001 Yeager
6,270,950 B1 8/2001 Bourdelais et al.
6,273,609 B1 8/2001 Johnson
6,274,181 B1 8/2001 Richison et al.
6,279,298 B1 8/2001 Thomas et al.
6,279,745 B1 8/2001 Huynen et al.
6,286,191 B2 9/2001 Van Erden
6,286,999 B1 9/2001 Cappel et al.
6,287,001 B1 9/2001 Buchman
6,289,561 B1 9/2001 Provan et al.
6,290,391 B1 9/2001 Buchman
6,290,392 B1 9/2001 Sandor
6,292,986 B1 9/2001 Provan et al.
6,293,701 B1 9/2001 Tomic
6,294,264 B1 9/2001 Piper et al.
6,299,353 B1 10/2001 Piechocki et al.
6,299,720 B1 10/2001 Van Erden
6,303,199 B1 10/2001 Takada et al.
6,306,472 B1 10/2001 Buelow
6,316,114 B1 11/2001 Comer et al.
6,317,939 B1 11/2001 Malin
6,321,423 B1 11/2001 Johnson
6,334,711 B1 1/2002 Risgalla et al.
6,344,258 B1 2/2002 Rasmussen
6,345,911 B1 2/2002 Young et al.
6,347,437 B2 2/2002 Provan et al.
6,354,738 B1 3/2002 Buckman et al.
6,355,336 B1 3/2002 Wakabayashi et al.
6,357,915 B2 3/2002 Anderson
6,361,209 B1 3/2002 LaRue et al.
6,361,211 B1 3/2002 Tilman
6,361,212 B1 3/2002 Sprehe et al.
6,361,843 B1 3/2002 Smith et al.
6,364,530 B1 4/2002 Buchman
6,371,643 B2 4/2002 Saad et al.
6,371,644 B1 4/2002 Forman
6,372,359 B1 4/2002 Hayashi et al.
6,374,855 B1 4/2002 Hansen
6,376,035 B1 4/2002 Dobreski et al.
6,378,272 B1 4/2002 Archibald et al.
6,385,818 B1 5/2002 Savicki, Sr.
6,386,760 B1 5/2002 Tomic
6,390,676 B1 5/2002 Colombo et al.
6,391,404 B1 5/2002 Rosenbaum et al.
6,402,375 B1 6/2002 Schreiter et al.
6,403,174 B1 6/2002 Copeta
6,408,872 B1 6/2002 Skeens et al.
6,413,597 B1 7/2002 Hirai
6,439,771 B1 8/2002 Herrington, Jr.
6,450,686 B1 9/2002 May
6,451,426 B2 9/2002 Kong et al.
6,461,042 B1 10/2002 Tomic et al.
6,468,332 B2 10/2002 Goglio et al.
6,479,115 B2 11/2002 Fehn
6,481,889 B2 11/2002 Delsahut
6,481,890 B1 11/2002 VandenHeuvel
6,487,758 B2 12/2002 Shaffer et al.
6,489,022 B1 12/2002 Hamilton et al.
6,491,166 B1 12/2002 Compton et al.
6,491,433 B2 12/2002 Shabram, Jr. et al.
6,499,878 B1 12/2002 Dobreski et al.
6,499,879 B2 12/2002 Schneck
6,500,505 B2 12/2002 Piper et al.
6,503,588 B1 1/2003 Hayashi et al.
6,505,383 B2 1/2003 Machacek et al.
6,506,464 B1 1/2003 Montenieri et al.
6,513,659 B1 2/2003 Ogura et al.
6,517,242 B1 2/2003 Buchman
6,521,312 B1 2/2003 Keiser
6,524,002 B2 2/2003 Tomic
6,526,632 B1 3/2003 Blythe et al.
6,527,003 B1 3/2003 Webster
6,530,870 B2 3/2003 Buchman et al.
6,533,456 B1 3/2003 Buchman
D473,761 S 4/2003 Wilk et al.
6,539,594 B1 4/2003 Kasai et al.
6,550,965 B2 4/2003 Shaffer et al.
6,568,046 B1 5/2003 Savicki et al.
6,571,430 B1 6/2003 Savicki et al.
6,572,267 B1 6/2003 Forman
6,575,191 B2 6/2003 Skeens et al.
6,576,329 B2 6/2003 Kong
6,576,348 B2 6/2003 Eggers et al.
6,579,584 B1 6/2003 Compton
6,579,621 B1 6/2003 Shah
6,581,253 B2 6/2003 ErkenBrack
6,581,641 B2 6/2003 Skeens et al.
6,595,689 B1 7/2003 Borchardt et al.
D478,774 S 8/2003 Wilk et al.
6,602,580 B1 8/2003 Hamilton et al.
6,602,590 B2 8/2003 Ting et al.
6,604,634 B2 8/2003 Su
6,609,353 B1 8/2003 McMahon et al.
6,609,827 B2 8/2003 Bois et al.
6,611,996 B2 9/2003 Blythe et al.
6,620,474 B1 9/2003 Regnier et al.
6,622,857 B2 9/2003 Ohtsubo et al.
6,623,866 B2 9/2003 Migliorini et al.
6,632,021 B2 10/2003 Bois et al.
6,634,384 B2 10/2003 Skeens et al.
6,637,939 B2 10/2003 Huffer
6,656,548 B1 12/2003 Beckwith et al.
6,659,643 B2 12/2003 Plourde et al.
6,662,827 B1 12/2003 Clougherty et al.
6,663,284 B2 12/2003 Buckingham et al.
6,663,947 B2 12/2003 Freedman et al.
6,666,580 B2 12/2003 Bois
6,667,083 B2 12/2003 Hayashi et al.

6,675,982 B2 1/2004 Heil et al.
6,679,027 B2 1/2004 Schreiter
6,680,104 B2 1/2004 Boris et al.
6,682,792 B2 1/2004 Schmal et al.
6,691,383 B2 2/2004 Linton
6,692,147 B2 2/2004 Nelson
6,694,704 B1 2/2004 Ausnit
6,698,925 B2 3/2004 Bentsen
6,706,377 B2 3/2004 Peet
6,712,334 B2 3/2004 Motonaka et al.
6,712,509 B2 3/2004 Cappel
6,713,152 B2 3/2004 Chen et al.
6,715,644 B2 4/2004 Wilford
6,721,999 B2 4/2004 Meager
6,729,473 B2 5/2004 Anderson
6,739,755 B2 5/2004 Schreiter
6,753,370 B2 6/2004 Nakatsukasa et al.
6,755,568 B2 6/2004 Malone et al.
6,767,131 B2 7/2004 Taheri
6,773,163 B2 8/2004 Ichikawa et al.
6,777,089 B1 8/2004 Königer et al.
6,780,146 B2 8/2004 Thomas et al.
6,786,641 B2 9/2004 Plourde
6,789,690 B2 9/2004 Nieh et al.
6,794,021 B2 9/2004 Bader
6,796,933 B2 9/2004 Bois
6,799,680 B2 10/2004 Mak
6,799,890 B2 10/2004 Schneider et al.
6,810,642 B2 11/2004 Cortigiano, Sr.
6,817,763 B2 11/2004 Tomic
6,821,589 B2 11/2004 Dobreski et al.
6,824,885 B2 11/2004 Fitch et al.
6,826,808 B2 12/2004 Kutschka
6,827,105 B1 12/2004 Marble et al.
6,827,492 B2 12/2004 Cook
6,830,377 B2 12/2004 Schneider
6,833,170 B1 12/2004 Knoerzer et al.
6,835,257 B2 12/2004 Perrine
6,837,268 B2 1/2005 Skeens et al.
6,845,598 B1 1/2005 Melchoir
6,846,107 B2 1/2005 Sweeney et al.
6,846,532 B1 1/2005 Bensur
6,846,551 B2 1/2005 Genske et al.
RE38,694 E 2/2005 Nelson
6,851,248 B2 2/2005 Knight et al.
6,854,886 B2 2/2005 Piechocki et al.
6,862,980 B2 3/2005 Heil et al.
6,872,458 B1 3/2005 Rudd et al.
6,874,935 B2 4/2005 Edelman et al.
6,874,937 B2 4/2005 Ausnit
6,874,938 B2 4/2005 Price et al.
6,877,898 B2 4/2005 Berich et al.
6,883,665 B1 4/2005 Ahn
6,884,207 B2 4/2005 Pokusa
6,884,483 B2 4/2005 Hayashi et al.
6,901,637 B2 6/2005 Machacek
6,902,795 B1 6/2005 Ishii et al.
6,910,805 B2 6/2005 Johnson
6,910,806 B2 6/2005 Strand et al.
6,913,387 B2 7/2005 Strand et al.
6,925,688 B1 8/2005 Savicki
6,932,509 B2 8/2005 Shah et al.
6,939,597 B2 9/2005 Winget et al.
6,945,392 B2 9/2005 Furukawa et al.
6,946,176 B2 9/2005 Jousse et al.
6,954,969 B1 10/2005 Sprehe
6,955,465 B2 10/2005 Machacek et al.
6,957,915 B2 10/2005 Tankersley
6,960,374 B1 11/2005 Terada et al.
6,964,519 B2 11/2005 ErkenBrack
6,974,256 B2 12/2005 Kinigakis et al.
6,976,669 B2 12/2005 Van Zijll Langhout et al.
6,979,495 B2 12/2005 Keung et al.
6,983,845 B2 1/2006 Shah et al.
6,984,278 B2 1/2006 Anderson et al.
6,988,828 B2 1/2006 Linneweil
6,991,109 B1 1/2006 Shannon et al.
6,993,886 B2 2/2006 Johnson
6,996,879 B1 2/2006 Savicki
7,001,659 B2 2/2006 Iriyama
7,004,209 B2 2/2006 Davis et al.
7,004,632 B2 2/2006 Hamilton et al.
7,011,615 B2 3/2006 Price et al.
7,022,058 B2 4/2006 Lee
7,026,417 B2 4/2006 Yang et al.
7,036,988 B2 5/2006 Olechowski
7,048,136 B2 5/2006 Havens et al.
7,051,762 B2 5/2006 Haamer
7,077,570 B2 7/2006 Fukumori et al.
7,077,923 B2 7/2006 Lin
7,087,130 B2 8/2006 Wu et al.
7,087,277 B2 8/2006 Yang et al.
7,090,397 B2 8/2006 Stolmeier
7,090,398 B2 8/2006 Shibata
7,096,893 B2 8/2006 Vilalta et al.
7,097,359 B2 8/2006 Plourde et al.
7,108,147 B2 9/2006 Cheung
7,131,550 B2 11/2006 Vilalta et al.
7,138,025 B2 11/2006 Wu et al.
7,144,615 B2 12/2006 Peiffer et al.
7,157,126 B2 1/2007 Cosentino et al.
7,162,779 B2 1/2007 MacHacek
7,163,338 B2 1/2007 McCracken et al.
7,178,555 B2 2/2007 Engel et al.
7,244,223 B2 7/2007 Hartman et al.
7,578,320 B2 * 8/2009 Borchardt ..... 141/7
7,625,459 B2 * 12/2009 Wu et al. ..... 156/244.24
2001/0012550 A1 8/2001 Fehn
2001/0031371 A1 10/2001 Kong et al.
2001/0034999 A1 11/2001 Xiong et al.
2001/0038897 A1 11/2001 Curie et al.
2002/0012803 A1 1/2002 Kending
2002/0022144 A1 2/2002 Yang et al.
2002/0041964 A1 4/2002 Winget et al.
2002/0090151 A1 7/2002 Skeens et al.
2002/0097923 A1 7/2002 Dobreski et al.
2002/0124471 A1 9/2002 Anderson et al.
2002/0146551 A1 10/2002 Freedman et al.
2002/0160167 A1 10/2002 Bader
2002/0168118 A1 11/2002 Price
2002/0168119 A1 11/2002 Herrington, Jr.
2002/0168489 A1 11/2002 Ting et al.
2002/0168512 A1 11/2002 Eggers et al.
2002/0182390 A1 12/2002 Migliorini et al.
2002/0187326 A1 12/2002 Kong
2003/0012901 A1 1/2003 Bezek et al.
2003/0016887 A1 1/2003 Su
2003/0021925 A1 1/2003 Schmal et al.
2003/0024847 A1 2/2003 Malaspina
2003/0031387 A1 2/2003 Gipson et al.
2003/0053722 A1 3/2003 Eggermont
2003/0095727 A1 5/2003 Leighton
2003/0102245 A1 6/2003 Wang
2003/0116466 A1 6/2003 Goto
2003/0118253 A1 6/2003 Machacek
2003/0136798 A1 7/2003 Wilford
2003/0169948 A1 9/2003 Fenzl et al.
2003/0175457 A1 9/2003 Jousse et al.
2003/0207061 A1 11/2003 Hayashi et al.
2003/0219174 A1 11/2003 Piechocki
2003/0219177 A1 11/2003 Salvaro
2003/0219557 A1 11/2003 Denehy et al.
2003/0223654 A1 12/2003 Gerrits
2003/0235669 A1 12/2003 Yang et al.
2004/0000336 A1 1/2004 Goglio
2004/0000503 A1 1/2004 Shah et al.

2004/0001651 A1 1/2004 Pawloski
2004/0007494 A1 1/2004 Popeil et al.
2004/0014579 A1 1/2004 Sweeney et al.
2004/0022457 A1 2/2004 Brown et al.
2004/0028856 A1 2/2004 Smith et al.
2004/0040961 A1 3/2004 Vilalta et al.
2004/0049896 A1 3/2004 Savicki
2004/0050745 A1 3/2004 Lee et al.
2004/0057636 A1 3/2004 Ishizaki
2004/0058178 A1 3/2004 Yang et al.
2004/0078939 A1 4/2004 Pawloski
2004/0081375 A1 4/2004 Pokusa
2004/0091185 A1 5/2004 Shibata
2004/0091186 A1 5/2004 Shibata
2004/0098845 A1 5/2004 Fukumori et al.
2004/0105600 A1 6/2004 Floyd, Jr.
2004/0114837 A1 6/2004 Koyanagi
2004/0136617 A1 7/2004 Gerrits
2004/0136618 A1 7/2004 Ausnit et al.
2004/0136622 A1 7/2004 Shigeta et al.
2004/0165794 A1 8/2004 Plourde et al.
2004/0177595 A1 9/2004 Kozak
2004/0191438 A1 9/2004 Cosentino et al.
2004/0208400 A1 10/2004 Linneweil
2004/0211698 A1 10/2004 John Mak
2004/0213967 A1 10/2004 Peiffer et al.
2004/0223667 A1 11/2004 Shah et al.
2004/0234170 A1 11/2004 Pawloski et al.
2004/0252915 A1 12/2004 Nelson
2004/0256050 A1 12/2004 Wu
2005/0008266 A1 1/2005 Crunkleton et al.
2005/0014011 A1 1/2005 Oya
2005/0022472 A1 2/2005 Brakes et al.
2005/0025394 A1 2/2005 Kinigakis et al.
2005/0029704 A1 2/2005 Wu et al.
2005/0034425 A1 2/2005 Johnson
2005/0034806 A1 2/2005 Wu et al.
2005/0034807 A1 2/2005 Wu et al.
2005/0035020 A1 2/2005 Wu et al.
2005/0036717 A1 2/2005 Wu et al.
2005/0036718 A1 2/2005 Wu et al.
2005/0036719 A1 2/2005 Wu et al.
2005/0037164 A1 2/2005 Wu et al.
2005/0042441 A1 2/2005 Peiffer et al.
2005/0042468 A1 2/2005 Peiffer et al.
2005/0061812 A1 3/2005 Vilalta et al.
2005/0063620 A1 3/2005 Anderson
2005/0065007 A1 3/2005 Wu et al.
2005/0069229 A1 3/2005 McCracken et al.
2005/0103798 A1 5/2005 Luigi
2005/0123748 A1 6/2005 Paris
2005/0135710 A1 6/2005 Melchoir
2005/0147330 A1 7/2005 Lee
2005/0172577 A1 8/2005 Oltrogge
2005/0190995 A1 9/2005 Koyanagi
2005/0196076 A1 9/2005 Tanaka et al.
2005/0205455 A1 9/2005 Harrison
2005/0208282 A1 9/2005 Wood, Jr. et al.
2005/0220373 A1 10/2005 Wu
2005/0220374 A1 10/2005 Thomas et al.
2005/0220376 A1 10/2005 Tsukanome et al.
2005/0229365 A1 10/2005 Offa-Jones
2005/0235468 A1 10/2005 Borchardt et al.
2005/0238263 A1 10/2005 Ping
2005/0244083 A1 11/2005 McMahon et al.
2005/0245376 A1 11/2005 Savicki et al.
2005/0251973 A1 11/2005 Sprehe
2005/0259895 A1 11/2005 Kozak
2005/0271308 A1 12/2005 Pawloski
2005/0276524 A1 12/2005 Taheri
2005/0281489 A1 12/2005 Yeh et al.
2005/0281490 A1 12/2005 Schneider et al.
2005/0281493 A1 12/2005 Heinemeier et al.
2005/0281494 A1 12/2005 Allen et al.
2005/0282695 A1 12/2005 Yeager
2005/0286808 A1 12/2005 Zimmerman et al.
2005/0286810 A1 12/2005 Sprague et al.
2005/0286811 A1 12/2005 Sprague et al.
2005/0286812 A1 12/2005 Sprague et al.
2005/0286813 A1 12/2005 Borchardt
2005/0286817 A1 12/2005 Hall et al.
2006/0008185 A1 1/2006 Borchardt
2006/0008187 A1 1/2006 Armstrong
2006/0013514 A1 1/2006 Wu
2006/0029299 A1 2/2006 Share et al.
2006/0030472 A1 2/2006 Hartman et al.
2006/0034551 A1 2/2006 Linneweil
2006/0035046 A1 2/2006 Lee
2006/0035777 A1 2/2006 Johnson
2006/0048483 A1 3/2006 Tilman et al.
2006/0050999 A1 3/2006 Blythe et al.
2006/0053749 A1 3/2006 Scanlan
2006/0072860 A1 4/2006 Wu
2006/0073291 A1 4/2006 Wu
2006/0076058 A1 4/2006 Rypstra
2006/0093242 A1 5/2006 Anzini et al.
2006/0104548 A1 5/2006 Schreiter
2006/0105166 A1 5/2006 Lischefski et al.
2006/0110079 A1 5/2006 Zimmerman et al.
2006/0111226 A1 5/2006 Anzini et al.
2006/0120632 A1 6/2006 Han
2006/0120633 A1 6/2006 Goldenberg et al.
2006/0131328 A1 6/2006 Anderson
2006/0157140 A1 7/2006 Bergman et al.
2006/0159372 A1 7/2006 Plourde et al.
2006/0159576 A1 7/2006 Bergman et al.
2006/0165316 A1 7/2006 Cheung
2006/0172137 A1 8/2006 Champion
2006/0177156 A1 8/2006 Owen et al.
2006/0179620 A1 8/2006 MacHacek
2006/0182371 A1 8/2006 Borchardt
2006/0193540 A1 8/2006 Borchardt
2006/0201576 A1 9/2006 Domenig
2006/0225787 A1 10/2006 Newrones et al.
2006/0228057 A1 10/2006 Newrones et al.
2006/0251841 A1 11/2006 Yang et al.
2006/0263497 A1 11/2006 Hoffman
2006/0283148 A1 12/2006 Zimmerman et al.
2006/0292322 A1 12/2006 Nakajima et al.
2007/0090109 A1 4/2007 Gustavsson
2007/0092167 A1* 4/2007 Tilman et al. ..... 383/63
2007/0130733 A1 6/2007 Kasai
2007/0154118 A1 7/2007 Tilman et al.
2007/0172157 A1 7/2007 Buchman
2007/0232473 A1 10/2007 Hartman et al.

FOREIGN PATENT DOCUMENTS

DE 1 901 372 U 9/1964
DE 1 290 073 2/1969
DE 1 486 280 4/1969
DE 1 486 733 6/1969
DE 1 411 644 7/1969
DE 23 31 862 1/1975
DE 24 54 248 5/1976
DE 27 47 071 4/1979
DE 28 48 835 5/1980
DE 33 12 887 10/1984
DE 34 11 371 10/1985
DE 35 21 373 12/1986
DE 93 00 361 1/1994
DE 43 05 065 8/1994
DE 198 43 430 2/2000
EP 144 011 6/1985
EP 149 695 7/1985
EP 373 833 6/1990

| | | |
|---|---|---|
| EP | 450 741 | 10/1991 |
| EP | 505 057 | 9/1992 |
| EP | 633 193 | 1/1995 |
| EP | 729 901 | 9/1996 |
| EP | 767 105 | 4/1997 |
| EP | 808 776 | 11/1997 |
| EP | 1 231 155 | 8/2002 |
| EP | 1 407 681 | 4/2004 |
| FR | 2 353 452 | 6/1976 |
| FR | 2 380 953 | 2/1978 |
| FR | 2 603 164 | 3/1988 |
| FR | 2 695 108 | 3/1994 |
| GB | 154244 | 11/1919 |
| GB | 961222 | 6/1964 |
| GB | 1016476 | 1/1966 |
| GB | 1046963 | 10/1966 |
| GB | 1121514 | 7/1968 |
| GB | 1548244 | 7/1979 |
| GB | 2028081 | 3/1980 |
| GB | 1583503 | 1/1981 |
| GB | 2237553 | 5/1991 |
| JP | 55-090364 | 7/1980 |
| JP | 57-21579 | 2/1982 |
| JP | 61-166960 | 10/1986 |
| JP | 62-99534 | 6/1987 |
| JP | 62-192779 | 8/1987 |
| JP | 63-6278 | 1/1988 |
| JP | 63-6279 | 1/1988 |
| JP | 63-203559 | 8/1988 |
| JP | 1-099925 | 4/1989 |
| JP | 1-279073 | 11/1989 |
| JP | 3-212355 | 9/1991 |
| JP | 4-13543 | 2/1992 |
| JP | 4-13544 | 2/1992 |
| JP | 4-60847 | 5/1992 |
| JP | 5-051039 | 3/1993 |
| JP | 5-124656 | 5/1993 |
| JP | 6-3846 | 1/1994 |
| JP | 6-99991 | 4/1994 |
| JP | 6-329179 | 11/1994 |
| JP | 7-839 | 1/1995 |
| JP | 8-011942 | 1/1996 |
| JP | 8-198274 | 8/1996 |
| JP | 2000-281084 | 10/2000 |
| JP | 2001-173818 | 6/2001 |
| JP | 2001-233383 | 8/2001 |
| JP | 2001-247137 | 9/2001 |
| JP | 2002-193273 | 7/2002 |
| JP | 2002-302164 | 10/2002 |
| JP | 2003-507264 | 2/2003 |
| JP | 2004-123228 | 4/2004 |
| JP | 2004-531435 | 10/2004 |
| JP | 2004-359292 | 12/2004 |
| WO | WO 8600868 A1 * | 2/1986 |
| WO | WO 88/07479 | 10/1988 |
| WO | WO 98/57862 | 12/1998 |
| WO | WO 01/94227 | 12/2001 |
| WO | WO 02/14161 | 2/2002 |
| WO | WO 02/30772 | 4/2002 |
| WO | WO 02/74522 | 9/2002 |
| WO | WO 03/001096 | 1/2003 |
| WO | WO 2004/002840 | 1/2004 |
| WO | WO 2004/002841 | 1/2004 |
| WO | WO 2004/002850 | 1/2004 |
| WO | WO 2004/078590 | 9/2004 |
| WO | WO 2004/078591 | 9/2004 |
| WO | WO 2004/078609 | 9/2004 |
| WO | WO 2004/108556 | 12/2004 |
| WO | WO 2004/108557 | 12/2004 |
| WO | WO 2005/000706 | 1/2005 |
| WO | WO 2005/016774 | 2/2005 |
| WO | WO 2005/040005 | 5/2005 |
| WO | WO 2006/127739 | 11/2006 |

* cited by examiner

FLOW CHANNELS FOR A POUCH

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates generally to pouches, and particularly to a flow channel that may be used to evacuate a pouch.

2. Description of the Background of the Invention

Pouches are typically used for storage and preservation of perishable contents such as food. Perishable contents may be made to last longer with less degradation if stored under vacuum. Evacuable thermoplastic pouches have been designed to work with a vacuum source to allow storage of contents under vacuum. However, a problem with evacuating a thermoplastic pouch is that the pouch has flexible walls that are forced together into contact with one another as a result of the evacuation. Regions of the pouch interior may thus be blocked from the vacuum source by the contacting walls, making those regions difficult or impossible to evacuate. In response to this problem, evacuable thermoplastic pouches have been designed with various flow channels that function to prevent the pouch walls from coming into contact and blocking off regions of the pouch from the vacuum source.

One such pouch has a thick textured porous sheet that is affixed to an inner surface of a pouch wall over an aperture in the pouch wall. The sheet has dimensions similar to the pouch wall and functions to prevent the pouch walls from adhering to one another during evacuation. The sheet provides flow paths from the pouch interior to the aperture to prevent the pouch walls from adhering, thus preventing evacuation of the pouch. Another pouch has a strip of mesh or woven material that extends from the pouch interior to a mouth of the pouch. The strip of mesh may be inserted by a user or affixed to the pouch interior during manufacture. The strip may alternatively be comprised of a plurality of tubes held together to form the strip.

A further pouch has a strip of flexible plastic material attached to an interior of the pouch. The pouch has an aperture that extends through a wall of the pouch proximate an end of the pouch. The strip has a flat base and a plurality of ribs disposed lengthwise on one side of the base. A first end of the strip is attached to the interior of the pouch opposite the aperture. A second end of the strip is attached to a region of the interior that is at an opposite end of the pouch from the aperture. The ribs provide fluid communication between the aperture and the entire length of the strip.

Other pouches have protuberances that are extruded integrally with a sidewall or embossed onto a sidewall of the pouch between an interior of the pouch and an evacuation aperture. Each protuberance has a body that extends away from the sidewall between a base end and a distal end. The body has parallel side walls or is generally tapered from the base end to the smaller distal end. The protuberances may take the form of discrete shapes or may be joined to form ridges. The protuberances may also be arranged irregularly or formed into patterns. Channels formed between the protuberances provide fluid communication between the evacuation aperture and the interior of the pouch.

Yet another pouch has one or more wall panels that are formed from a material that is pressed between rollers to impart a corrugated cross-section to the material. Grooves and ridges formed by the rollers are imparted on an angle with respect to the direction of forming. The material is folded upon itself to form the pouch with the wall panels, wherein the pouch has grooves and ridges in each wall panel that intersect with grooves and ridges on an opposing wall panel. The intersecting grooves and ridges prevent the wall material from flattening under evacuation, thereby creating air channels throughout the pouch.

Still another pouch has a pattern of channels on a sidewall that is created by pressing a melt-extruded resin between rollers. The channels have baffles that allow gases to escape from the pouch, yet trap liquid within the pouch. Another pouch has at least one sidewall that has a zigzag pattern of channels or ridges formed therein or thereon, respectively.

Pouches that have flow channels may have regions of the pouch interior blocked from a vacuum source by an opposing sidewall that has entirely collapsed into a channel due to the inherent flexibility of the opposing sidewall material. Narrower flow channels can lessen blockage caused by the collapsed opposite sidewall, but also have decreased flow volume. Sidewalls made of more rigid material can also lessen blockage by limiting collapse, but necessarily have less flexibility.

SUMMARY OF THE INVENTION

According to one aspect of the invention, a pouch includes first and second opposing pouch walls and a plurality of flow channel protuberances that defines a flow channel between the first and second pouch walls and is disposed on an inner surface of at least one of the first or second pouch walls. At least one of the plurality of protuberances includes a first component that extends from the at least one of the first or second pouch walls and a second component that extends at a non-zero angle from the first component. The flow channel extends between an opening of the pouch and a portion of an interior of the pouch that is spaced from the opening.

According to another aspect of the invention, a pouch includes first and second opposing pouch walls. A flow channel profile is disposed on an inner surface of the first pouch wall, and a complementary groove is disposed on an inner surface of the second pouch wall to releasably engage with the flow channel profile to define a flow channel between the first and second pouch walls. The flow channel extends between an opening of the pouch and a portion of an interior of the pouch that is spaced from the opening.

According to yet another aspect of the invention, a pouch includes a pouch wall and a flow channel profile, wherein the flow channel profile includes a first component extending from the pouch wall and a second component extending at a non-zero angle from the first component. The flow channel profile is disposed on an inner surface of the pouch wall to define a flow channel disposed between the pouch wall and an opposing surface and that extends between an opening of the pouch and a portion of an interior of the pouch that is spaced from the opening.

BRIEF DESCRIPTION OF THE DRAWINGS

Other aspects and advantages of the present invention will become apparent upon consideration of the following detailed description, wherein similar structures have similar reference numerals.

DETAILED DESCRIPTION

Figure 1:
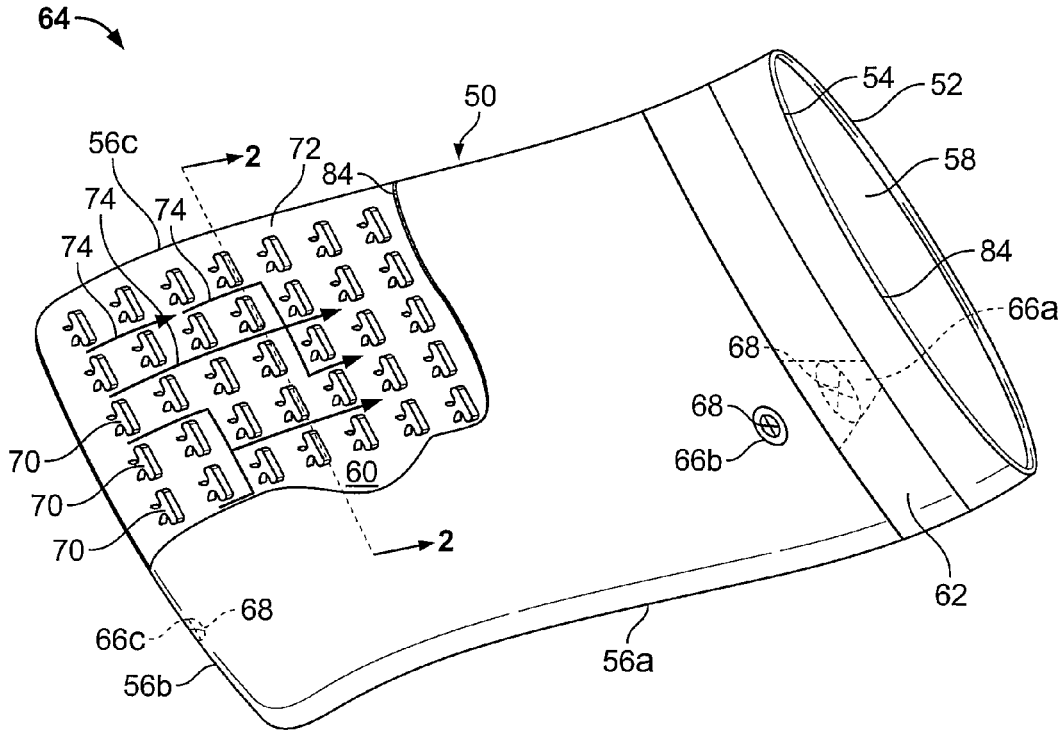
FIG. 1 is an isometric partial cutaway view of a pouch illustrating a plurality of flow channel protuberances extending from an inner surface of a first pouch wall.

Referring to FIG. 1, a reclosable pouch 50 has a first sidewall 52 and a second sidewall 54. Illustratively, the first and second sidewalls 52, 54 may be made of one or more thermoplastic materials or resins such as polyolefin, including, for example, polyethylene and polypropylene. The first and second sidewalls 52, 54 are joined at three edges 56*a*-56*c* by heat sealing or any other sealing method known in the art to define a mouth 58 leading to an interior 60. The edge 56*b* may also be a fold line separating a single piece of material into the first and second sidewalls 52 and 54. The first sidewall 52 includes an inner surface 72 and the second sidewall 54 includes an inner surface 84.

A closure mechanism 62 extends across the pouch 50 proximate the mouth 58. The closure mechanism 62 allows the pouch 50 to be repeatedly opened and closed. When occluded, the closure mechanism 62 provides an airtight seal such that a vacuum may be maintained in the pouch interior 60 for a desired period of time, such as days, months, or years, when the closure mechanism is sealed fully across the mouth 58. The closure mechanism 62 comprises first and second closure elements (not shown) that are attached respectively to the inner surfaces 72 and 84 of the first and second sidewalls 52 and 54. The first closure element includes one or more interlocking closure profiles (not shown), and the second closure element also includes one or more interlocking closure profiles (not shown). The first and second interlocking closure profiles may be male and female closure profiles, respectively. However, the configuration and geometry of the interlocking profiles or closure elements disclosed herein may vary.

In a further embodiment, one or both of the first and second closure elements (not shown) may include one or more textured portions, such as a bump or crosswise groove in one or more of the first and second closure profiles in order to provide a tactile sensation, such as a series of clicks, as a user draws the fingers along the closure mechanism 62 to seal the closure elements across the mouth 58. In another embodiment, the first and second interlocking closure profiles (not shown) include textured portions along the length of each profile to provide tactile and/or audible sensations when closing the closure mechanism 62. In addition, protuberances, for example ridges (not shown), may be disposed on the inner surfaces 72, 84 of the respective first and second sidewalls 52, 54 proximate the mouth 58 to provide increased traction in a convenient area for a user to grip, such as a gripping flange, when trying to open the sealed pouch 50. Further, in some embodiments, a sealing material such as a polyolefin material or a caulking composition such as silicone grease may be disposed on or in the interlocking profiles or closure elements to fill in any gaps or spaces therein when occluded. The ends of the interlocking profiles or closure elements may also be welded or sealed by ultrasonic vibrations as is known in the art. Illustrative interlocking profiles, closure elements, sealing materials, tactile or audible closure elements, and/or end seals useful in the present invention include those disclosed in, for example, Pawloski U.S. Pat. No. 4,927,474, Dais et al. U.S. Pat. Nos. 5,070,584, 5,478,228, and 6,021,557, Tomic et al. U.S. Pat. No. 5,655,273, Sprehe U.S. Pat. No. 6,954,969, Kasai et al. U.S. Pat. No. 5,689,866, Ausnit U.S. Pat. No. 6,185,796, Wright et al. U.S. Pat. No. 7,041,249, Pawloski et al. U.S. Pat. No. 7,137,736, Anderson U.S. Patent Application Publication No. 2004/0091179, Pawloski U.S. Patent Application Publication No. 2004/0234172, Tilman et al. U.S. Patent Application Publication No. 2006/0048483, and Anzini et al. U.S. Patent Application Publication Nos. 2006/0093242 and 2006/0111226. Other interlocking profiles and closure elements useful in the present invention include those disclosed in, for example, U.S. patent application Ser. No. 11/725,120, filed Mar. 16, 2007, and U.S. patent application Ser. Nos. 11/818,585, 11/818,593, and 11/818,586, each filed on Jun. 15, 2007. It is further appreciated that the interlocking profiles or closure elements disclosed herein may be operated by hand, or a slider (not shown) may be used to assist in occluding and de-occluding the interlocking profiles and closure elements.

An exterior 64 of the pouch 50 is also shown in FIG. 1. An opening 66*a*, 66*b*, or 66*c* allows fluid communication between the interior 60 and the exterior 64 of the pouch 50. The opening 66*a* may extend through or around the closure mechanism 62. Alternatively, the opening 66*b* may extend through either the first or second sidewall 52, 54. The opening 66*c* may also extend through a side edge 56*a*-56*c*, for example, through the bottom edge 56*b*. A valve 68 may optionally be disposed in or covering the opening 66*a*-66*c* to allow air to be evacuated from the pouch interior 60 and maintain a vacuum when the closure mechanism 62 has been sealed. As shown in FIG. 1, the valve 68 may be disposed on the second sidewall 54 spaced from the closure mechanism 62. The valve 68 provides a fluid path with fluid communication between the pouch interior 60 and the exterior 64 of the pouch. Illustrative valves useful in the present invention include those disclosed in, for example, Newrones et al. U.S. Patent application publication No. 2006/0228057. Other valves useful in the present invention include those disclosed in, for example, U.S. patent application Ser. Nos. 11/818,592, 11/818,586, and 11/818,591, each filed on Jun. 15, 2007.

Although not shown, in some embodiments an evacuation pump or device may be used to evacuate fluid from the pouch 50 through, for example, the valve 68 disposed in one of the sidewalls 52, 54, or in the closure mechanism 62 or one of the side edges 56*a*-56*c* of the pouch. Illustrative evacuation pumps or devices useful in the present invention include those disclosed in, for example, U.S. patent application Ser. No. 11/818,703, filed on Jun. 15, 2007.

Figure 2:
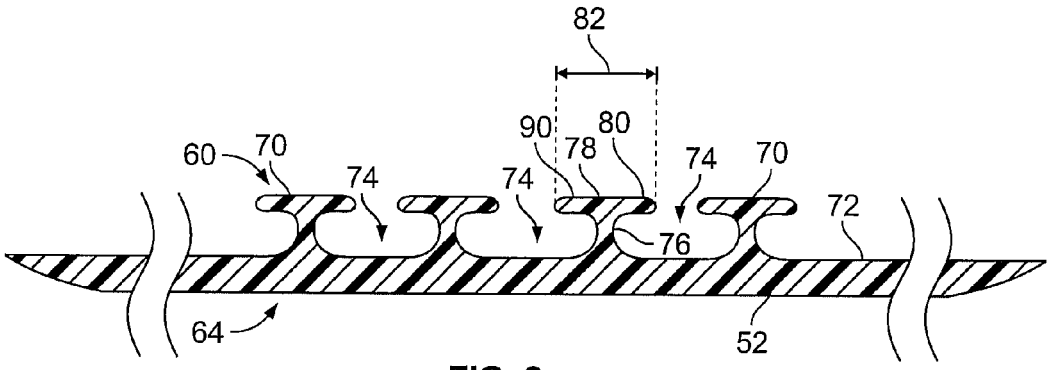
FIG. 2 is a fragmentary cross-sectional view of a first embodiment of flow channels taken generally along the lines 2-2 of FIG. 1 with portions behind the plane of the cross-section omitted for clarity.

In a first embodiment shown in FIGS. 1 and 2, a plurality of flow channel protuberances 70 are arranged regularly or irregularly on the inner surface 72 of the first sidewall 52. The protuberances 70 define flow channels 74 between the first and second sidewalls 52, 54 as depicted, for example, by the lines and arrows in FIGS. 1 and 2, and that extend from the interior 60 to the opening 66*a*-66*c* of the pouch 50. Illustratively, the flow channel 74 provides fluid communication between the opening 66*a*-66*c* and a portion of the interior 60 that is spaced from the opening 66*a*-66*c*. For example, an embodiment including the opening 66*b* that extends through a first sidewall 52 includes a flow channel 74 that extends from directly opposite the opening to a portion of the interior 60 that is spaced from the opening. Alternatively, embodiments including either of the openings 66*a* or 66*c* include a flow channel 74 that extends from directly adjacent the opening to a portion of the interior 60 that is spaced from the opening. The flow channels 74 defined by the protuberances 70 may be straight or curved. The flow channels 74 defined by the protuberances 70 may be parallel to one another, or in other embodiments not shown, may extend radially away from the opening 66*a*-66*c* in, for example, an expanding sunburst configuration, or may have any other configuration such that the flow channels 74 provide fluid communication between the opening 66*a*-66*c* and a portion of the pouch interior 60 spaced from the opening when the pouch 50 is under vacuum pressure.

Referring to FIG. 2, the protuberances 70 may be integral with the first sidewall 52. Each of the protuberances 70 includes a first component 76 that extends from the first sidewall 52. Each protuberance 70 also includes a second component 78 that extends laterally away from the first component 76 proximate a distal end 80 thereof. The second component 78 may be round or square or any convenient shape and may extend laterally away from the first component 76 at any non-zero angle with respect to the first component 76 around a part or an entire periphery thereof. The second component 78 provides increased surface area 82 on a distal end 90 of each protuberance 70.

Further, a solid material that includes fixed or supported portions is displaced at an unsupported portion in response to a force applied to the unsupported portion. The amount of displacement depends upon, for example, the span of the unsupported portion, the amount and distribution of force applied thereto, and/or a material property of the solid material called the flex modulus. For example, in the pouch 50 being evacuated, unsupported portions of each of the first and second sidewalls 52, 54 may sag into the flow channel 74 by an amount that depends upon spacing between respective ends of the protuberances 70, the flex modulus for the material in each of the first and second sidewalls, and/or the level of vacuum drawn on the pouch. Assuming a given composition for the first and second sidewalls 52, 54, and a given level of vacuum drawn on the pouch, the amount of sag of each of the first and second sidewalls therefore depends on the spacing between respective ends of the protuberances 70. The increased surface area 82 makes contact over an increased area of the inner surface 84 of the second sidewall 54, thereby leaving less of the second sidewall 54 disposed over the flow channel 74 unsupported during evacuation of the pouch 50. Inhibiting sag of the first and second sidewalls 52, 54 into the flow channels 74 allows the flow channels to remain open for a longer period of time while fluid is being evacuated therefrom and from the pouch.

Figure 3:
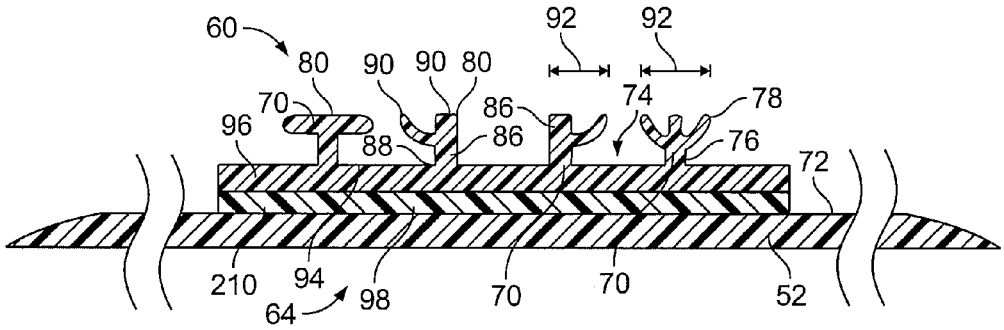
FIG. 3 is a fragmentary cross-sectional view illustrating other embodiments of flow channels taken generally along the lines 2-2 of FIG. 1 with portions behind the plane of the cross-section omitted for clarity.

Referring next to FIG. 3, the second component 78 of each flow channel protuberance 70 may also extend from an intermediate region 86 that may be at any position on the first component 76 between a base end 88 and the distal end 80 thereof. The second component 78 may again be any convenient shape and may extend laterally away from the first component 76 at any non-zero angle with respect to the first component 76 around a part or the entire periphery thereof. The second component 78 extends from the intermediate region 86 to increase the effective surface area 92 at the distal end 90 of the protuberance 70. Similar to the above, increased surface area 92 in contact with the inner surface 84 of the second sidewall 54 leaves less of the second sidewall 54 unsupported during evacuation of the pouch 50.

The flow channel protuberances 70 may also depend from a first side 94 of a base member 96, as illustrated in FIG. 3. A second side 98 of the base member 96 is affixed to the inner surface 72 of the first sidewall 52. The base member 96 may be affixed to the first sidewall 52 by a thermoplastic weld layer 210, a heat seal, an adhesive, or any other method known in the art. In each of the embodiments included herein, the flow channel protuberances 70 or profiles 100 (shown in FIGS. 4-9) may either be integral with the first sidewall 52 as described with respect to FIG. 2, or may depend from the first side 94 of the base member 96 as described with respect to FIG. 3. The flow channel protuberances 70 or profiles 100 may be extruded integrally with the base member 96 to form a three dimensional tape structure that may be fastened to the inner surfaces 72, 84 of the respective first and second sidewalls 52, 54 of the pouch 50 to create the flow channels 74.

Figure 4:
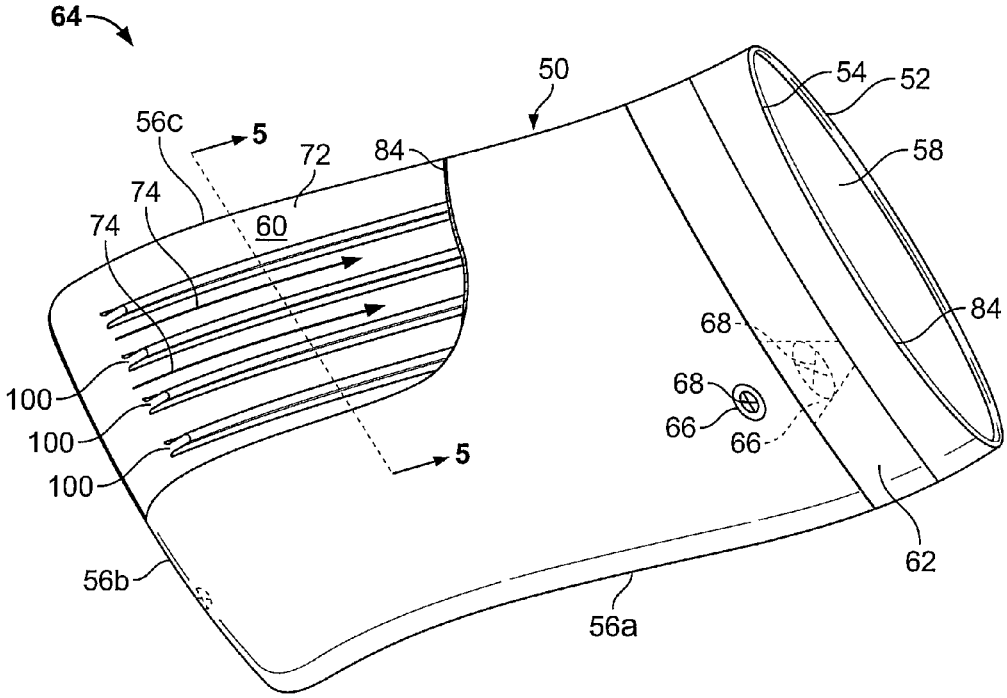
FIG. 4 is an isometric partial cutaway view of a pouch illustrating a further embodiment of flow channels.
Figure 5:
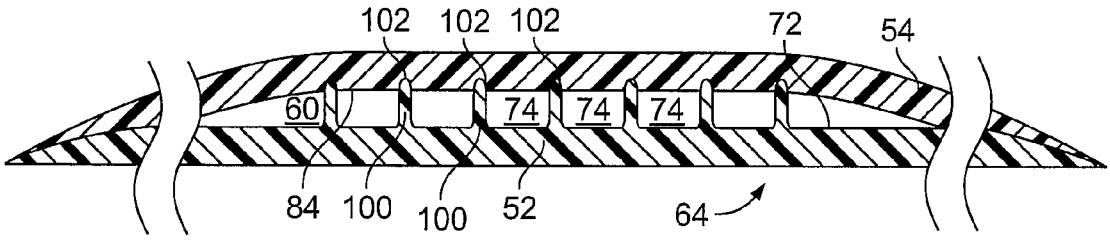
FIG. 5 is a fragmentary cross-sectional view taken generally along the lines 5-5 of FIG. 4 with portions behind the plane of the cross-section omitted for clarity.

Referring next to FIGS. 4 and 5, in a further embodiment, flow channel profiles 100 define flow channels 74 between the first and second sidewalls 52, 54 as depicted, for example, by the lines and arrows in FIG. 4, and that extend from the interior 60 to the opening 66*a*-66*c* of the pouch 50. Grooves 102 are provided on the inner surface 84 of the second sidewall 54. The grooves 102 align and engage with the flow channel profiles 100 when the pouch 50 is brought under vacuum pressure. The engaged profiles and grooves 100, 102 may reduce or limit lateral displacement of the second sidewall 54 across the profiles 100. The engaged profiles and grooves 100, 102 may also reduce or limit bowing of the profiles 100 in response to vacuum pressure. Therefore, the engaged profiles and grooves 100, 102 may provide increased effective structural rigidity for sections of the second sidewall 54 between the grooves 102. The engaged profiles and grooves 100, 102 therefore may lessen blockage of the flow channels 74 by limiting collapse of the second sidewall 54 during evacuation of the pouch 50. The flow channel profiles 100 of this embodiment may also be integral with the first sidewall 52 as disclosed in detail above with respect to FIG. 2, or may depend from the base member 96 that is affixed to the inner surface 72 of the first sidewall 52, as disclosed in detail above with respect to FIG. 3.

Figure 6:
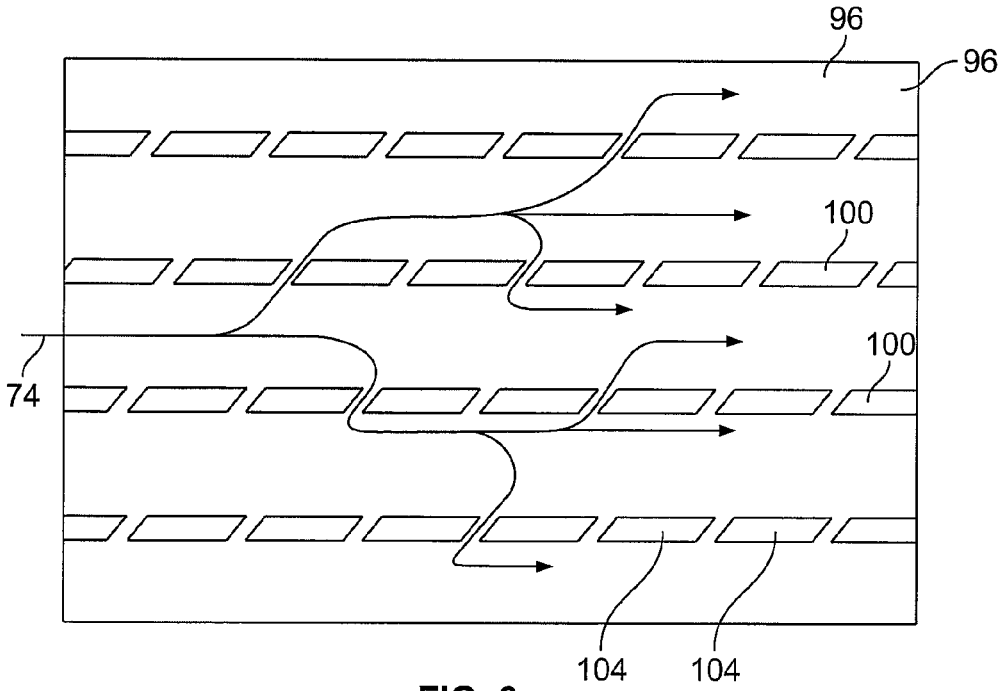
FIG. 6 is a plan view of yet another embodiment of flow channels illustrating segmented flow channel profiles.

Referring now to FIG. 6, the flow channel profiles 100 may also be cut into segments 104. The segmented flow channel profiles 100 define flow channels 74 between the first and second sidewalls 52, 54 as depicted, for example, by the lines and arrows in FIG. 6, and that extend from a portion of the interior 60 to the opening 66*a*-66*c* of the pouch 50. The flow channel profiles 100 and corresponding grooves 102 may be straight or curved. The profiles 100 may be parallel to one another, or in other embodiments not shown, may extend radially away from the opening 66*a*-66*c* in an expanding sunburst configuration, or may have any other configuration such that the continuous flow channels 74 provide fluid communication between the opening 66*a*-66*c* and a portion of the pouch interior 60 spaced from the opening when the pouch 50 is under vacuum pressure.

Figure 7:
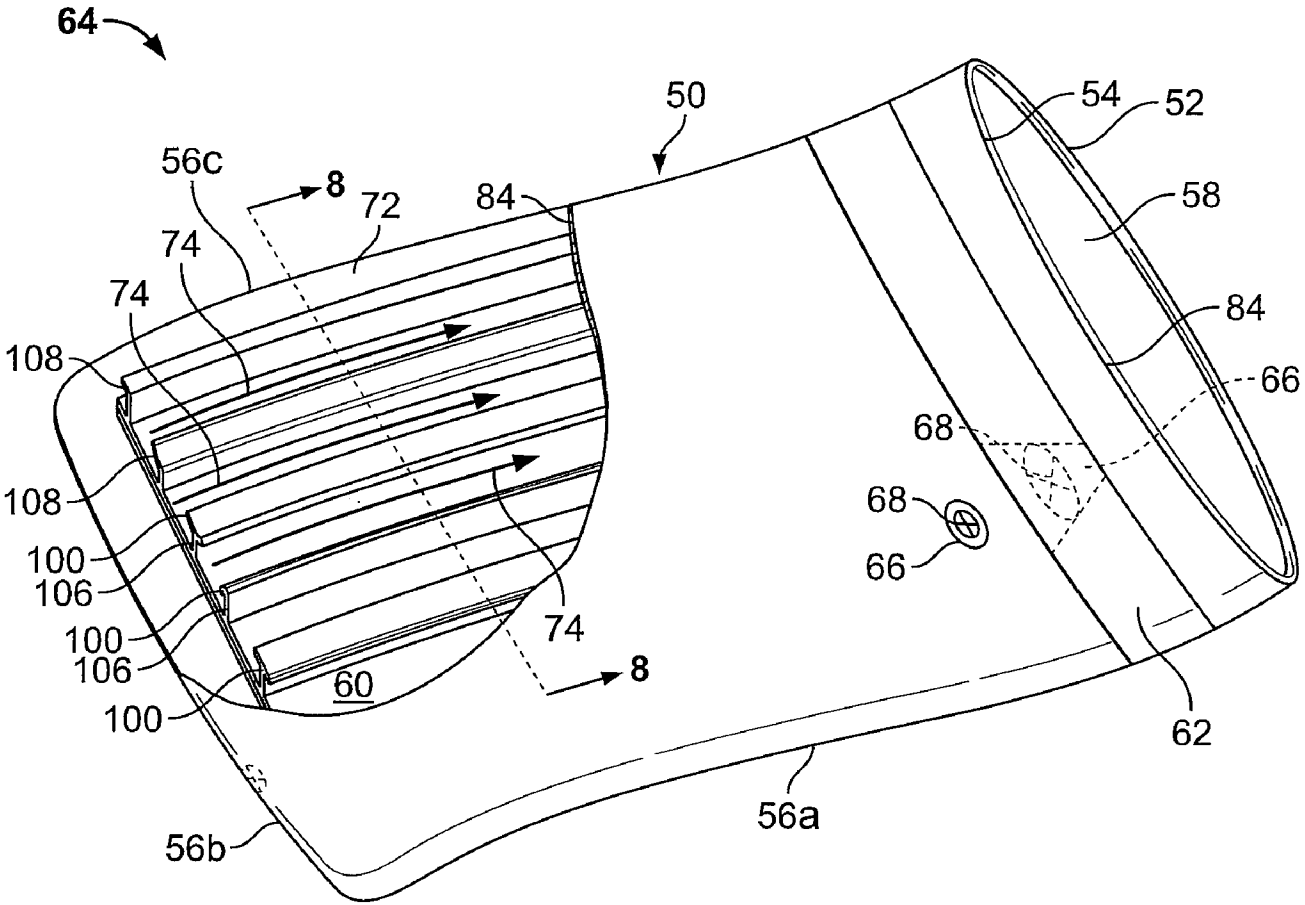
FIG. 7 is an isometric partial cutaway view illustrating a still further embodiment of flow channels.
Figure 8:
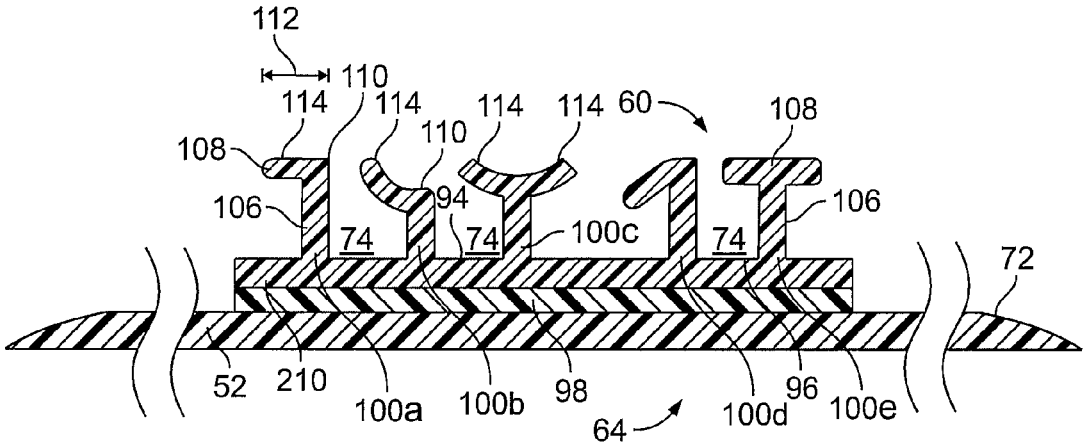
FIG. 8 is a fragmentary cross-sectional view similar to the views of FIGS. 2, 3, and 5, and illustrating still further embodiments of flow channels.

Referring next to FIGS. 7 and 8, the flow channel profiles 100*a*-100*e* each have a first component 106 that extends from the inner surface 72 of the first sidewall 52 or from the first side 94 of the base member 96 that is affixed to the inner surface 72 of the first sidewall 52, as disclosed in detail above with respect to FIG. 3. Each profile 100*a*-100*e* also includes a second component 108 that extends laterally from the first component 106 proximate a distal end 110 thereof. The second component 108 may have a straight or curved cross section and may extend laterally away from one side of the first component 106, as illustrated in left-most profile 100*a* in FIG. 8, or may extend laterally away from both sides of the first component 106 as illustrated in right-most profile 100*e* in FIG. 8.

Illustratively, the second component 108 may extend laterally away from the first component 106 perpendicular to the first component 106, as shown in profiles 100*a* and 100*e* in FIG. 8. In another embodiment, the second component 108 may extend laterally away from the first component 106 at an obtuse angle as illustrated in profiles 100*b* and 100*c* in FIG. 8. Further, in a further embodiment, the second component 108 may extend laterally away from the first component 106 at an acute angle as illustrated in profile 100*d* in FIG. 8. The second component 108 provides increased surface area 112 on a distal end 114 of each profile 100*a*-100*e*, and as discussed above, provides additional support area for the second sidewall 54 to assist in preventing collapse thereof into the channel 74 when the pouch 50 is being evacuated.

Figure 9:
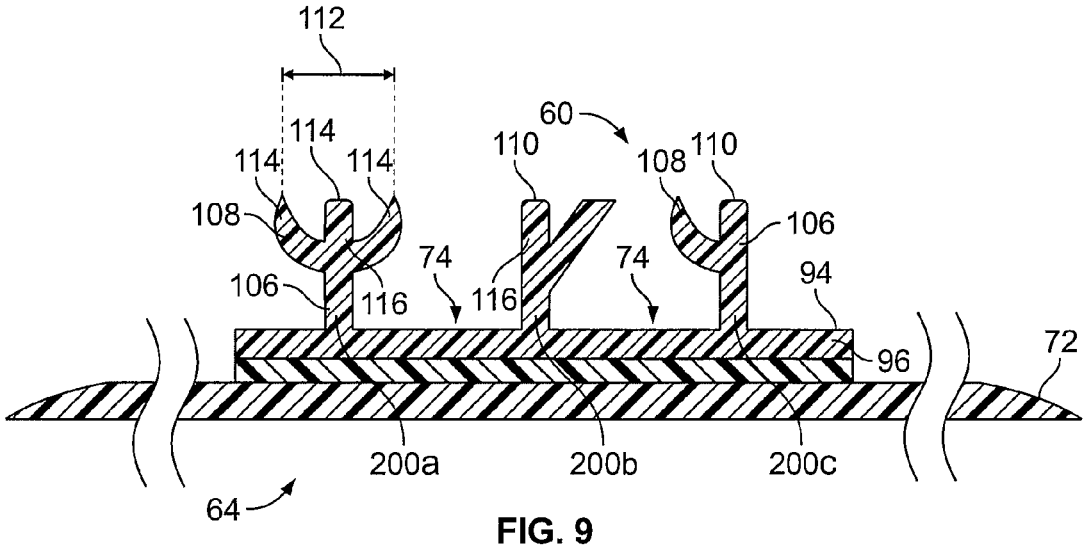
FIG. 9 is a cross-sectional view similar to the views of FIGS. 2, 3, 5, and 8, and illustrating still other embodiments of flow channels.

Referring next to FIG. 9, in still other embodiments, the second component 108 of each of the flow channel profiles 200*a*-200*c* may also extend from an intermediate region 116 of the first component 106 between a base end 118 and the distal end 110 thereof. In one embodiment, the second component 108 may have a straight or curved cross section and may extend laterally away from both sides of the first component 106 as illustrated in left-most profile 200*a* in FIG. 8, or in other embodiments, may extend laterally away from one side of the first component 106, as illustrated in profiles 200*b* and 200*c* in FIG. 9. The second component 108 may extend laterally away from the first component 106 at any non-zero angle with respect to the first component 106, for example, an acute angle, an obtuse angle, or a 90 degree angle. The second component 108 may extend from both sides of the first component 106 and away from the base member 96 as illustrated by left-most flow channel profile 200*a* in FIG. 9, because such a configuration may provide an increased effective surface area 112 across the distal end 114 of the profile 200*a*.

The flow channel profiles 100*a*-100*e* and 200*a*-200*c* may be straight or curved. The profiles 100*a*-100*e* and 200*a*-200*c* may be parallel to one another, or in other embodiments not shown, may extend radially away from the opening 66*a*-66*c* in an expanding sunburst configuration, or may have any other configuration such that the continuous flow channels 74 provide fluid communication between the opening 66*a*-66*c* and a portion of the pouch interior 60 spaced from the opening when the pouch 50 is under vacuum pressure.

Although not shown, one or both sidewalls, such as the second sidewall 54, may also be embossed or otherwise textured with a pattern, such as a diamond pattern, on one or both surfaces spaced between the bottom edge 56*b* and the closure mechanism 62, or a separate textured and embossed patterned wall may be used to provide additional flow channels (not shown) within the pouch interior 64. Illustrative flow channels useful in the present invention include those disclosed in Zimmerman et al. U.S. Patent Application Publication No. 2005/0286808 and Tilman et al. U.S. Patent Application Publication No 2006/0048483.

In one embodiment, the first and second sidewalls 52, 54 and/or the closure mechanism 62 are formed from thermoplastic resins by known extrusion methods. For example, the sidewalls 52, 54 may be independently extruded of thermoplastic material as a single continuous or multi-ply web, and the closure mechanism 62 may be extruded of the same or different thermoplastic material(s) separately as continuous lengths or strands. Illustrative thermoplastic materials include polypropylene (PP), polyethylene (PE), metallocene-polyethylene (mPE), low density polyethylene (LDPE), linear low density polyethylene (LLDPE), ultra low density polyethylene (ULDPE), biaxially-oriented polyethylene terephthalate (BPET), high density polyethylene (HDPE), polyethylene terephthalate (PET), among other polyolefin plastomers and combinations and blends thereof. Further, the inner surfaces 152, 154 of the respective sidewalls 52, 54 or a portion or area thereof may, for example, be composed of a polyolefin plastomer such as an AFFINITY™ resin manufactured by Dow Plastics. Such portions or areas include, for example, the area of one or both of the sidewalls 52, 54 proximate and parallel to the closure mechanism 60 to provide an additional cohesive seal between the sidewalls when the pouch 50 is evacuated of fluid. One or more of the sidewalls 52, 54 in other embodiments may also be formed of air-impermeable film. An example of an air-impermeable film includes a film having one or more barrier layers, such as an ethylene-vinyl alcohol copolymer (EVOH) ply or a nylon ply, disposed between or on one or more of the plies of the sidewalls 52, 54. The barrier layer may be, for example, adhesively secured between the PP and/or LDPE plies to provide a multilayer film. Other additives such as colorants, slip agents, and antioxidants, including for example talc, oleamide or hydroxyl hydrocinnamate may also be added as desired. In another embodiment, the closure mechanism 62 may be extruded primarily of molten PE with various amounts of slip component, colorant, and talc additives in a separate process. The fully formed closure mechanism 62 may be attached to the pouch body using a strip of molten thermoplastic weld material, or by an adhesive known by those skilled in the art, for example. Other thermoplastic resins and air-impermeable films useful in the present invention include those disclosed in, for example, Tilman et al. U.S. Patent application publication No 2006/0048483.

The protuberances 70, and flow channel profiles 100, 100*a*-100*e*, and 200*a*-200*c* as disclosed herein may be composed of any thermoplastic material such as would be used for the first and second sidewalls 52 and 54 of the pouch 50 as disclosed herein. Illustratively, the protuberances 70, and flow channel profiles 100, 100*a*-100*e*, and 200*a*-200*c* may, for example, be composed of a polyolefin plastomer such as an AFFINITY™ resin manufactured by Dow Plastics.

The resealable pouch 50 described herein can be made by various techniques known to those skilled in the art including those described in, for example, Geiger, et al., U.S. Pat. No. 4,755,248. Other useful techniques to make a resealable pouch include those described in, for example, Zieke et al., U.S. Pat. No. 4,741,789. Additional techniques to make a resealable pouch include those described in, for example, Porchia et al., U.S. Pat. No. 5,012,561. Additional examples of making a resealable pouch as described herein include, for example, a cast post applied process, a cast integral process, and/or a blown process.

INDUSTRIAL APPLICABILITY

Flow channels within a pouch may be used to evacuate fluid from the pouch, thereby allowing pouch contents, such as food, to remain fresher for extended periods of time. Flow channels allow a vacuum source to reach interior regions of the pouch that are spaced from the vacuum source. The flow channels herein are defined by structures having first and second components that together provide an increased surface area that prevents collapse of an opposing pouch wall when the pouch is subjected to vacuum evacuation.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved. All patents, patent publications and applications, and other references cited herein are incorporated by reference herein in their entirety.

We claim:

1. A pouch, comprising:

first and second opposing pouch walls; and a plurality of flow channel protuberances that defines a flow channel between the first and second pouch walls and is disposed on an inner surface of the first pouch wall; and at least one of the plurality of protuberances comprising an elongate profile including a first component that extends away from the first pouch wall and a second component spaced from the first pouch wall that extends at a non-zero angle from the first component;

wherein the flow channel extends between an opening of the pouch and a portion of an interior of the pouch that is spaced from the opening; and wherein the second component extends laterally from an intermediate region of the first component between and spaced from a base end and a distal end of the first component.

2. The pouch of claim 1, wherein the first and second opposing pouch walls are a thermoplastic resin, and the plurality of flow channel protuberances is integral with and extends from a first side of a base member, and a second side of the base member is attached to the inner surface of at least one of the first or second pouch walls.

3. The pouch of claim 2, wherein the second side of the base member is attached to the inner surface of at least one of the first or second pouch walls by a thermoplastic weld layer.

4. The pouch of claim 1, wherein the plurality of flow channel protuberances is separately extruded and applied to the inner surface of the at least one of the first or second pouch walls.

5. The pouch of claim 1 further comprising an airtight closure mechanism disposed at the opening of the pouch, and a one-way valve in fluid communication with the flow channel.

6. A pouch, comprising:

a pouch wall; and a flow channel profile comprising a first component extending from the pouch wall and a second component extending at a non-zero angle from the first component and disposed on an inner surface of the pouch wall to define a flow channel disposed between the pouch wall and an opposing surface and that extends between an opening of the pouch and a portion of an interior of the pouch that is spaced from the opening;

wherein the second component extends laterally from an intermediate region of the first component between and spaced from a base end and a distal end of the first component.

7. The pouch of claim 6, wherein the flow channel profile is segmented.

8. The pouch of claim 6, wherein a plurality of flow channel profiles is separately extruded and applied to the inner surface of the pouch wall.

9. The pouch of claim 6, wherein the pouch wall and the opposing surface are a thermoplastic resin, and the flow channel profile is integral with and extends from a first side of a base member and a second side of the base member is attached to the inner surface of the pouch wall.

10. The pouch of claim 9, wherein the second side of the base member is attached to the inner surface of the pouch wall by a thermoplastic weld layer.

11. The pouch of claim 9 further comprising a valve disposed in the opening of the pouch and a resealable airtight closure mechanism disposed proximate a mouth of the pouch to seal the pouch, wherein the pouch wall and the opposing surface define the mouth.

12. The pouch of claim 11, wherein the flow channel is in fluid communication with the valve.

* * * * *